US006453952B1

(12) United States Patent
Verclyte

(10) Patent No.: US 6,453,952 B1
(45) Date of Patent: Sep. 24, 2002

(54) THREAD GRIPPER FOR A RAPIER OF A RAPIER LOOM

(75) Inventor: Eddy Verclyte, Leper (BE)

(73) Assignee: Picanol, n.v., Leper (BE)

( * ) Notice: Subject to any disclaimer, the term of this patent is extended or adjusted under 35 U.S.C. 154(b) by 0 days.

(21) Appl. No.: 09/807,435

(22) PCT Filed: Oct. 5, 1999

(86) PCT No.: PCT/EP99/07353

§ 371 (c)(1),
(2), (4) Date: Apr. 23, 2001

(87) PCT Pub. No.: WO00/23642

PCT Pub. Date: Apr. 27, 2000

(30) Foreign Application Priority Data

Oct. 21, 1998 (BE) ..... 9800755
Feb. 3, 1999 (BE) ..... 9900070

(51) Int. Cl.[7] ..... D03D 47/23
(52) U.S. Cl. ..... 139/448
(58) Field of Search ..... 139/448

(56) References Cited

U.S. PATENT DOCUMENTS 4,231,402 A * 11/1980 Merisio ..... 139/448
4,708,174 A * 11/1987 Vandeweghe et al. ..... 139/448
5,492,153 A * 2/1996 Stacher et al. ..... 139/448
6,065,506 A * 5/2000 Scari et al. ..... 139/448

FOREIGN PATENT DOCUMENTS

EP 0 207 533 * 1/1987

* cited by examiner

*Primary Examiner*—Andy Falik
(74) *Attorney, Agent, or Firm*—Bacon & Thomas, PLLC

(57) ABSTRACT

A yarn clamp (13) for a gripper of a rapier weaving machine includes two clamp elements for clamping a filling yarn (2). Each clamp element is fitted with one clamping segment (20, 25) and the segments are located opposite each other. The clamping segment (20) of at least one of the clamp elements is adjustable by means of an adjustment device (30) relative to the other clamping segment (25) and relative to the main body (18) of the one clamping segment.

21 Claims, 6 Drawing Sheets

THREAD GRIPPER FOR A RAPIER OF A RAPIER LOOM

BACKGROUND OF THE INVENTION

1. Field of the Invention

The invention relates to a yarn clamp for a gripper of a rapier weaving machine and comprising two clamp elements for clamping a filling yarn, the clamping elements comprising clamping segments located in opposed relationship.

2. Related Art

A filling is kept in readiness in rapier weaving machines on the insertion side of a shed and is taken by a drawing gripper, clamped and inserted into this shed. Approximately at the center of the shed the filling is transferred to a receiving gripper which clamps the yarn and moves it to the opposite shed side. In order to clamp the filling, drawing grippers and/or receiving grippers are fitted with a yarn clamp comprising two clamp elements which clamp a single filling. One of the clamp elements is secured in fixed manner to the gripper and the other is displaceable relative to it. In a known design, the clamp element fixedly secured to the gripper includes slots that receive screws with play and which secure the clamp element to the gripper. Accordingly, the fixed clamp element can be secured at different positions relative to the displaceable clamp element. However, this design makes it difficult to align the fixed clamp element at a location that fits with the location of the filling to be clamped.

The object is solved by mounting the clamping segment of at least one of the clamp elements in an adjustable manner relative to the clamping segment of the other clamp element and relative to the main body of the at least one clamp element.

Because the adjustable clamping segment is moveable relative to itsw main body and the clamping segment of the other clamp element, the position of the clamping segments is easily adjustable relative to the filling to be clamped without requiring changing the position at which the yarn clamp is secured to the gripper.

SUMMARY OF THE INVENTION

An object of the invention is to offer an improved yarn clamp for a gripper.

In a preferred embodiment of the present invention, by means of an adjustable device an elastically bendable or flexible joint is provided between the main body of one clamp element and the adjustable clamping segment. In another embodiment the adjustable clamping segment is mounted by means of a retainer to the main body and an elastically bendable joint is provided between the clamping segment and the retainer. This elastically bendable joint enables adjustment of the adjustable clamping segment while eliminating the need for wear-susceptible parts. a retainer to the main body and an elastically bendable joint is provided between the clamping segment and the retainer. This elastically bendable joint enables adjustment of the adjustable clamping segment while eliminating the need for wear-susceptible parts.

In another preferred embodiment, the adjustment device for the moveable clamping segment includes an adjusting screw mounted in the area of a joint between the main body or the retainer and the adjustable clamping segment. This enables continuous adjustment of the adjustable clamping segment relative to the other clamping segment.

In yet another embodiment of the invention, the movable clamp element is a leaf spring having a clamping segment, the end of which that is located away from the clamping segment being secured to an extension of the main body of the other clamp element. This arrangement has the advantage of easy manufacture of the movable clamp element.

In yet another embodiment of the invention, the adjusting device(s) is or are fitted with stops to limit the adjustment excursion. As a result, clamping segment adjustment is precluded from exceeding the elastic limit of the elastically bendable joint.

BRIEF DESCRIPTION OF THE DRAWINGS

Further features and advantage of the invention are elucidated in the following description of the illustrative embodiments shown in the drawings.

DETAILED DESCRIPTION OF THE INVENTION

Figure 1:
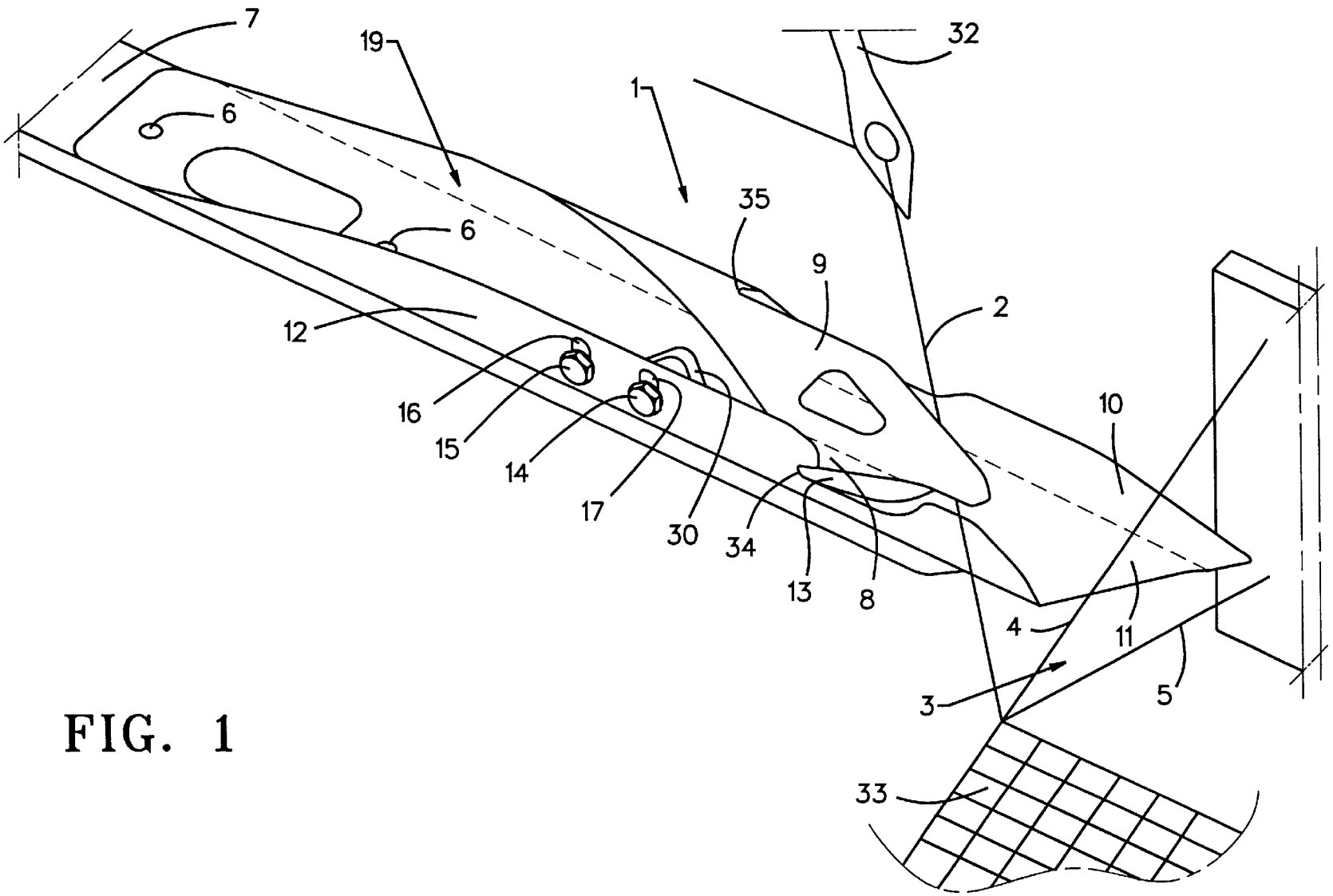
FIG. 1 is a perspective view of a drawing gripper with a yarn clamp according to the invention.
Figure 2:
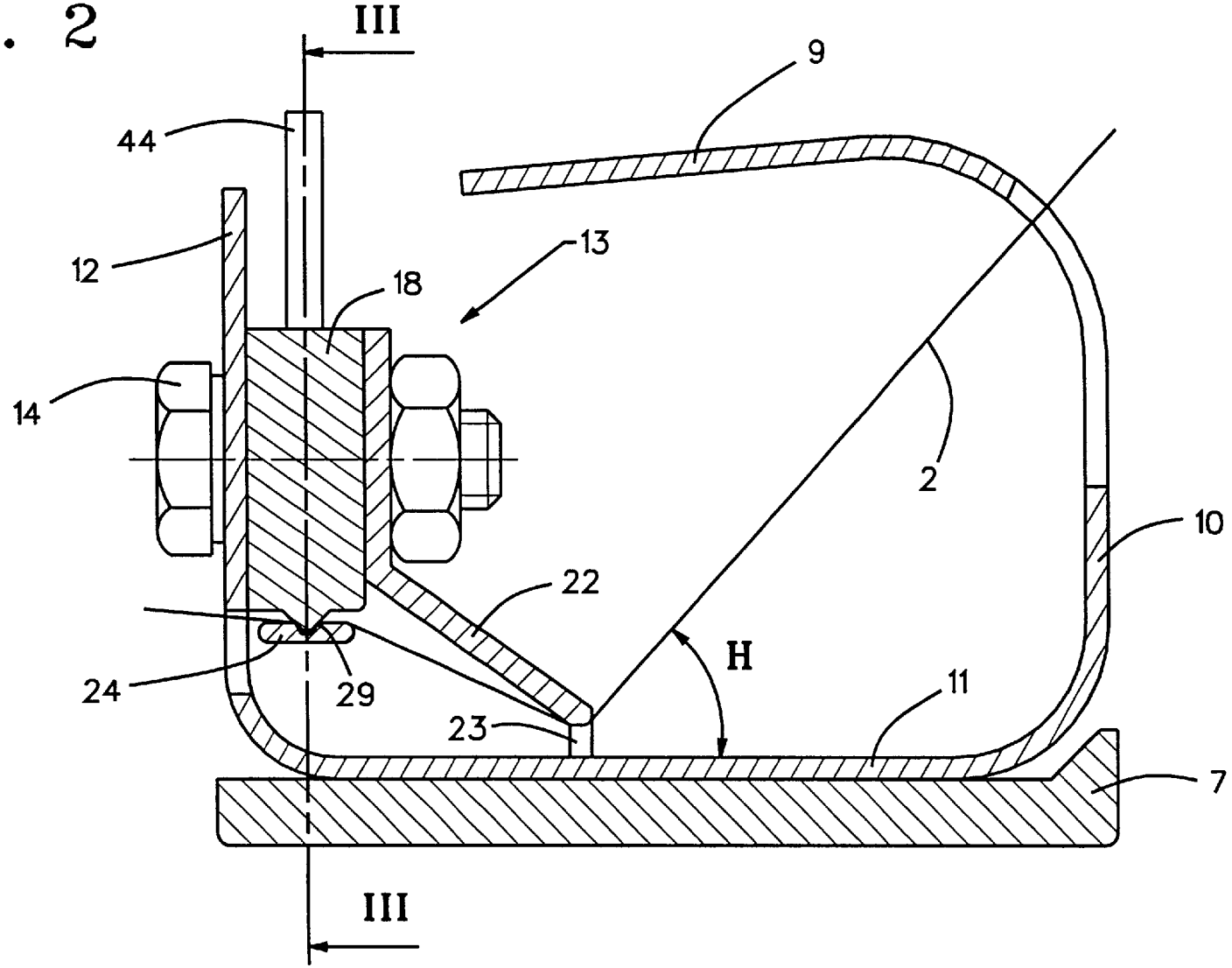
FIG. 2 is a section view along line II—II of FIG. 3 of the drawing gripper of FIG. 1.
Figure 3:
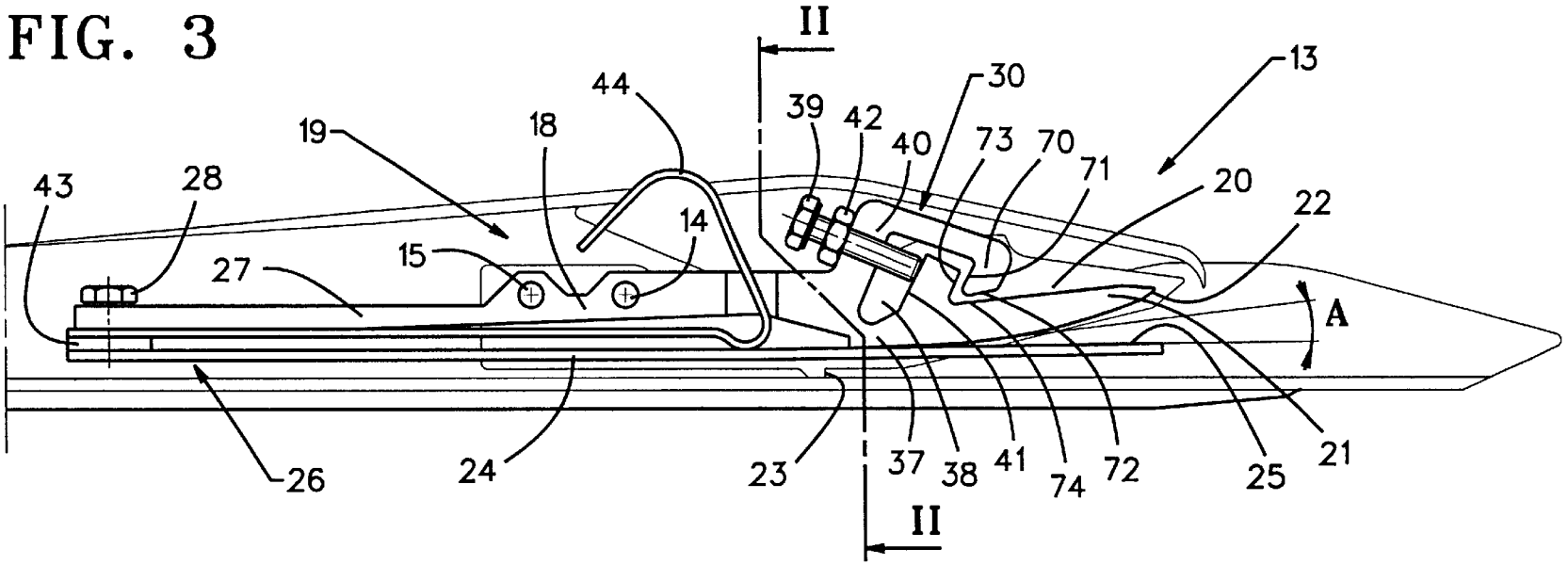
FIG. 3 is a section view along line III—III of FIG. 2 showing the yarn clamp in the closed position.

FIGS. 1 through 5 show a drawing gripper 1 inserting a filling yarn 2 into a shed 3 located between warp-yarn sheets 4 and 5. In manner known per se, the drawing gripper 1 is secured by threaded fasteners 6 to the forward end of a rapier 7. The rapier 7 is driven by a drive system that is not shown and the drawing gripper 1 is moved into and out of the shed 3 by the rapier 7 in order to insert a filling 2 into the shed. The drawing gripper 1 includes a hollow housing 19 comprising several sections 8, 9, 10, 11 and 12 of a sheet of bent metal. Illustratively the metal sheet may be made of an aluminum alloy, steel or other metal. A yarn clamp 13 for clamping a filling yarn 2 is secured by fasteners 14, 15 to the housing 19 in the area of the gripper section 12. The fasteners 14, 15 pass through slots 16, 17 running transversely to the length direction of the gripper and as a result the yarn clamp 13 may be secured in a pre-selected position on the gripper housing 19.

The yarn clamp 13 comprises a main body 18 secured by the threaded fasteners 14, 15 on the section 12 of the gripper housing 19. This secured main body 18 is integral in one piece with a main body clamping segment 20, the underside of which forms one filling clamping surface 21. In addition a yarn guide 22 is affixed by the fasteners 14, 15 to the main body 18 and guides the filling 2 downward to the bottom zone of the gripper housing 19 until this filling 2 abuts a stop 23 of the yarn guide 22.

The yarn clamp 13 also contains a movable clamp element 24 in the form of a leaf spring, for instance, made of spring steel. The top side of this leaf spring constitutes a clamping segment 25 for the filling 2 which is opposed to the clamping surface 21 of the relatively fixed clamping segment 20. The end 26 of the moveable clamp element 24 located away from the clamping segment 25 is mounted by a fastener 28 to an extension portion 27 of the fixed main body 18. Being pre-stressed, the clamp element 24 exerts a defined clamping force by its clamping segment 25 against the clamping segment 20. The clamping surface 21 of the clamping segment 20 is fitted with a substantially triangular rib as viewed in cross-section that cooperates with a groove 29 in the moveable clamp element 24.

The yarn clamp 13 also contains a movable clamp element 24 in the form of a leaf spring, for instance, made of spring steel. The top side of this leaf spring constitutes a clamping segment 25 for the filling 2 which is opposed to the clamping surface 21 of the relatively fixed clamping segment 20. The end 26 of the moveable clamp element 24 located away from the clamping segment 25 is mounted by a fastener 28 to an extension 27 of the fixed main body 18. Being pre-stressed, the clamp element 24 exerts a defined clamping force by its clamping segment 25 against the clamping segment 20. The clamping surface 21 of the clamping segment 20 is fitted with a substantially triangular rib as viewed in cross-section that cooperates with a groove 29 in the moveable clamp element 24.

When, as shown in FIG. 1, the drawing gripper 1 is readied for the shed 3, it will receive a filling 2 which is kept for that purpose between a feed needle 32 and the fabric 33. The filling 2 is guided underneath the section 9 by means of the edges of clearances in the sections 10 and 12 until it runs against the stops 34 and 35 of the gripper housing 19. In the process the filling 2 is received in the yarn clamp 13 and runs against the stop 23 of the yarn guide 22. As shown in the cross-section of FIG. 2, the filling runs between the stop 23 and the stop 35 at an angle H of about 50° relative to the section 11 constituting the bottom of the gripper housing 19. The filling 2 is clamped in the yarn clamp 13 between the stop 34 and the stop 23. As soon as the filling 2 is held clamped in the yarn clamp 13, it shall be cut off by a cutter (not shown) in the vicinity of the fabric 33 and then will be inserted into the shed 3. During this insertion the filling 2 is taken from a supply of yarn (not shown), specifically a pre-winder or a bobbin.

The clamping segment 20 is adjustable—relative to the main body 18 and the clamping segment 25 of the moveable clamp element 24—through the angle A (FIG. 3) which, with the yarn clamp 13 closed, is subtended between the clamping surface 21 and the clamping segment 25. For that purpose an elastically bendable connection 37 is provided between the clamping segment 20 and the main body 18. In this embodiment the connection comprises a narrow strip in the vicinity of the underside of clamping segment 20 formed by a milling 38. A portion adjuster screw 39 located a distance away from the elastically bendable connection 37 is screwed into a protrusion 40 of the main body 18 and at its opposite end engages a sidewall 41 of the milling 38. A locknut 42 secures the adjustment screw 39 in the protrusion 40 of the main body 18.

Figure 4:
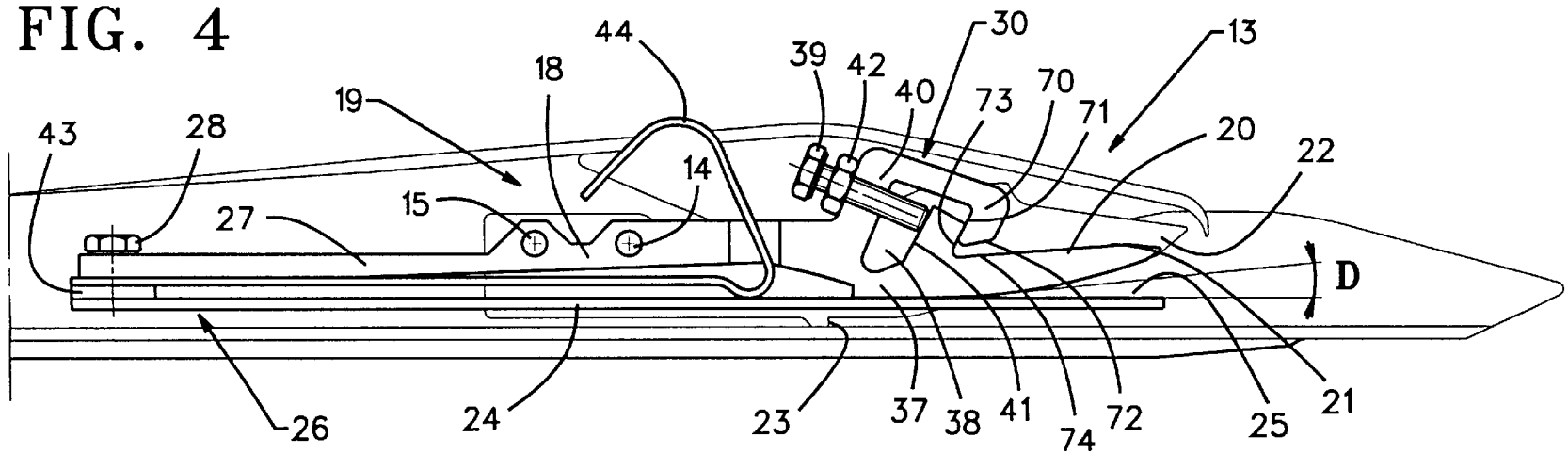
FIG. 4 is a section view corresponding to FIG. 3 with the adjustable clamping segment located at a maximum adjustment position.

If the adjustment screw 39 is screwed deeper through the protrusion 40 as shown in FIG. 4, the elastically bendable connection 37 will be deformed relative to the non-bent portion of the main body and the angle A becomes angle D. The adjustment screw 39 allows continuous adjustment of the position of the clamping segment 20.

The adjustment device—denoted overall by 30—of the clamping segment 20 furthermore is fitted with an excursion limit-stop to limit the adjustment excursion in such a way that the bending of connection 37 shall remain within the elastic range. For that purpose and in this embodiment, a hook-shaped stop 70 is located at the protrusion 40 and, by means of a stop surface 71, engages a stop surface 73 of the clamping segment 20. Once the stop surface 73 engages the stop surface 71, maximum adjustment of the clamping segment 20 has been attained. In this manner the elastic connection 37 is prevented from excessive deformation that would result in plastic deformation of the connection. Plastic deformation would damage the entire yarn clamp 13 because it could no longer be returned to a desired angular position. By means of the above-described adjustment, an angle between the values of A and D may be matched to the fillings being processed in a way that shall not affect the relative positions of main body 18 and drawing gripper 1. On account of the cooperation of the elastically bendable connection 37 and the adjustment screw 39, the adjustment of the clamping segment 20 will not be affected by friction and/or play and/or wear of the adjusting device. An adjustment can be changed again at will without thereby acting on the adjustment means. The angle A through D may be matched precisely and most importantly continuously. This feature is significant primarily when weaving fillings consisting of several thin threads or so-called filaments that together form one relatively thick filling yarn. The more filaments that are present, the smaller the angle A,D is which must be selected.

Figure 5:
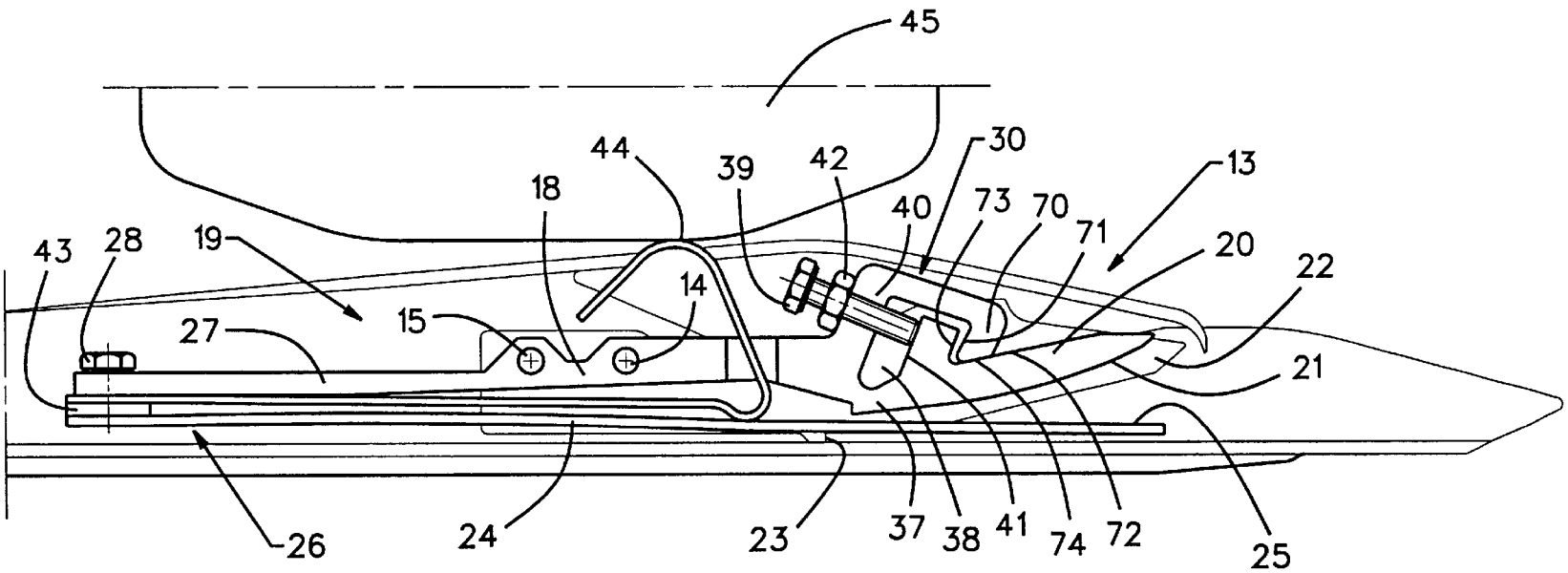
FIG. 5 is a section view similar to FIG. 3 at the other end position of the clamping segment with the yarn clamp open.

In the embodiment of the adjustment device shown in FIG. 5, the stop surface 72 of the hook-shaped stop 70 engages a stop surface 74 of the clamping segment 20, and as a result further deformation of the elastically bendable connection 37 will be limited. Consequently, the clamping segment 20 always will be pressed with a defined force against the adjustment screw, said defined force being generated as a spring force by the elastically bendable connection 37.

The moveable clamp element 24 also can be moved by a moving device 44 in the form of a bent leaf spring as shown in FIG. 5. The clamping segment 25 of the moveable clamp element 24 may be moved away from the clamping surface 21 of the fixed clamping segment 20 such that the yarn clamp 13 will be opened, for instance for purposes of cleaning. In this process and in a known manner, the device 44 cooperates with a stop 45 shown in FIG. 5 which is mounted in a fixed manner on the weaving machine frame (not shown). This stop 45 is configured in such a way next to the path of the drawing gripper 1 that during motion of the gripper 1 adjacent this stop 45, the device 44 will be pressed inward by said stop 45 and hence will open the yarn clamp 13. The adjustment device 44 is secured by the fastener 28 on the extension 27 of the main body 18 together with the moveable clamp element 24 and spacer 43.

Figure 6:
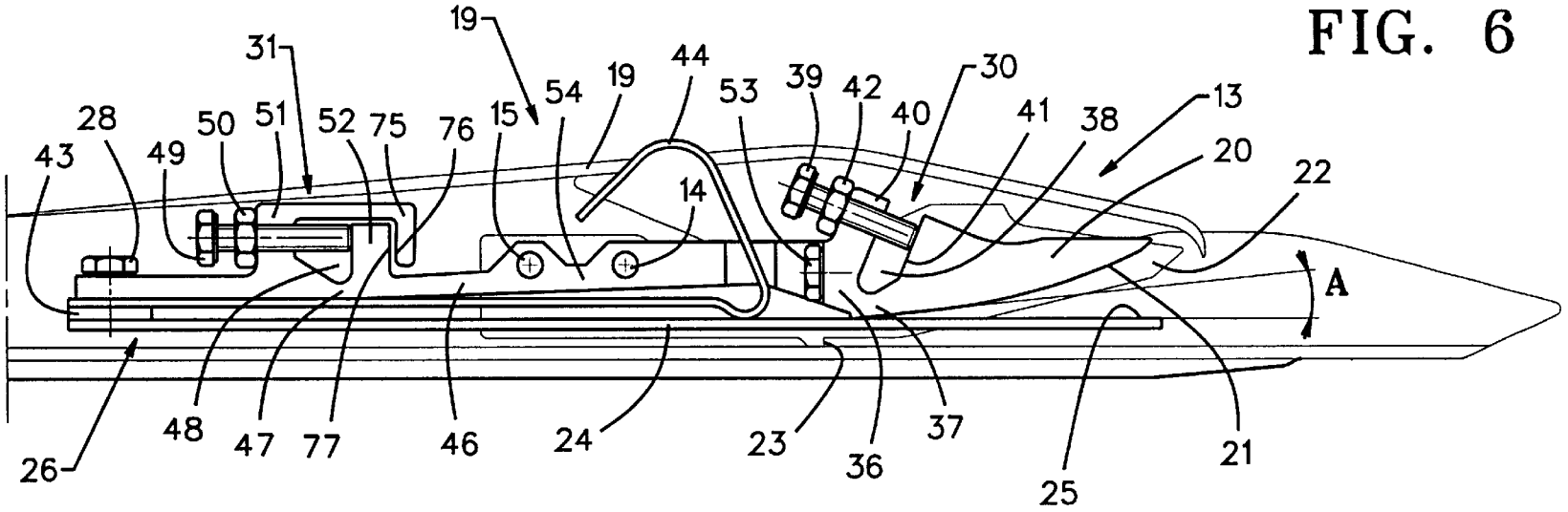
FIG. 6 is a section similar to FIG. 3 of a different embodiment using another adjustment system.
Figure 7:
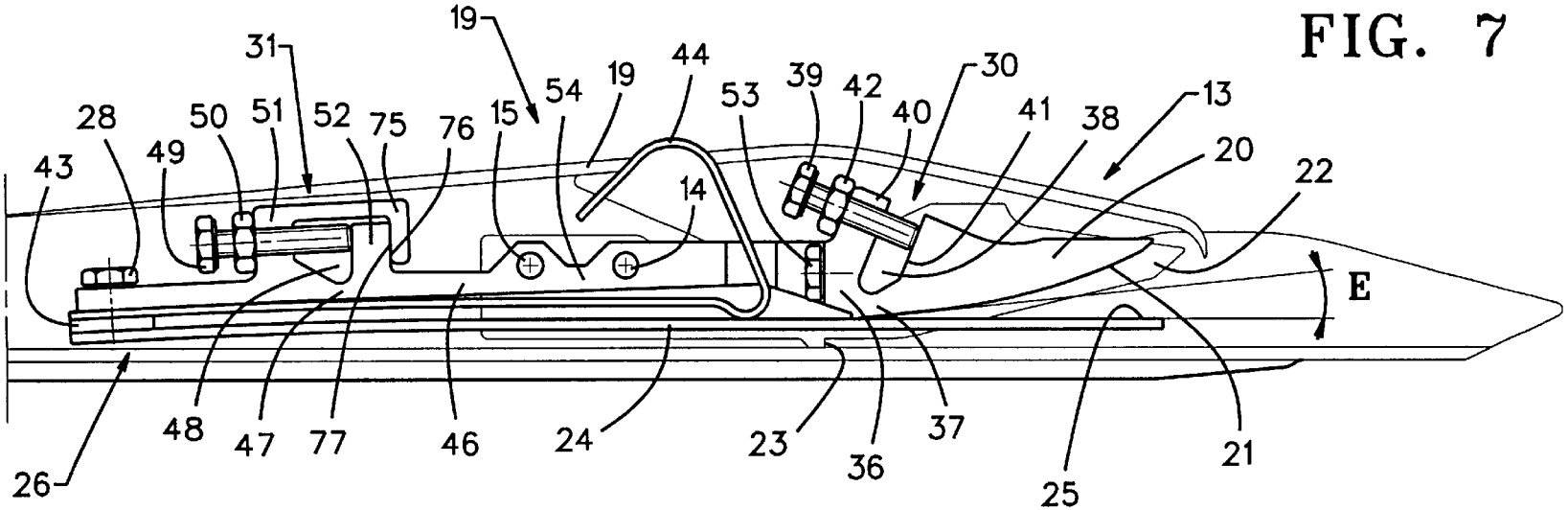
FIG. 7 shows the embodiment of FIG. 6 with the second adjustment device located at an end position.

In the embodiment of FIGS. 6 and 7, the adjustment device 30 lacks a hook-shaped stop limiting the adjustment path. In this embodiment however the adjustment can be limited in that the adjustment screw 39 is designed with a limited length.

A second adjustment device 31 is provided in addition to the adjustment device 30 and also allows adjusting the angle between the clamping surface 21 of the clamping segment 20 and the clamping segment 25 of the clamp element 24 when the yarn clamp 13 is closed. The clamp element 24 is designed in the manner of the embodiment of FIGS. 1 through 5 and is affixed by a fastener 28 to an extension 46 of the main body 54 of the fixed clamp. The main body 54 is affixed by fasteners 14, 15 to the gripper housing 19 in the manner shown in FIGS. 1 through 5. The extension 46 is divided into two parts which are connected to each other by an elastically bendable joint 47. A cavity 48 is milled into the zone of this joint 47 and is bounded on both sides by protrusions 51, 52. An adjustment screw 49 is screwed into the protrusion 51 and is opposite a side wall of the protrusion 52. A locknut 50 is provided on the adjustment screw 49. The protrusion 51 is fitted with a hook-shaped stop 75 constituting a stop surface 76 for engaging an opposite surface 77 of the protrusion 52, in this manner limiting the maximum adjustment excursion. In this embodiment the angular position of the clamping segment 25 of the clamp 24 can be changed by means of the adjustment device 31 relative to the clamping surface 21 of the clamping segment 20 by correspondingly deforming the extension 46 in the zone of the elastically bendable joint 47.

When, in the embodiment of FIG. 6, the adjustment screw 49 is rotated and is screwed further into the protrusion 51, then the joint 47 will be elastically bent. As a result, the angle A between the clamping surface 21 of the clamping segment 20 and the clamping segment 25 of the clamp 24 changes into the angle E corresponding to FIG. 7. Rotating the adjustment screw 49 involves only a minor angular change between the clamping surface 21 and the clamping segment 25. This minor change is enabled by the fact that the elastic joint 47 is mounted at a substantial distance away or remote from the clamping segment 25 of the clamp element 24 and in that the clamp element 24 is bending as a whole. Consequently the single adjustment screw allows comparatively fine control of the angular setting, in particular when the adjustment screw's pitch is appropriately selected. The adjustment device 30 and the elastically bendable connection 37 on the other hand being mounted comparatively near the clamping surface 21 of the clamp 20, adjusting the adjustment screw 39 will result in a relatively large angular change. Therefore the angular adjustment can be rapidly changed using the adjustment screw 39 whereas the adjustment screw 49 offers fine control.

At the position shown in FIG. 7 of the adjustment screw 49, the stop surface 77 of the protrusion 52 has engaged the stop surface 76 of the hook-shaped stop 75. The adjustment excursion is limited in this way and this limitation is designed to preclude plastic deformation of the elastic connection 47.

As regards the yarn clamp 13 as shown in the embodiment of FIGS. 6 and 7, the adjustment device 31 also may adjust the force exerted by the clamping segment 25 of the clamp element 24 on the clamping surface 21 of the clamping segment 20. Illustratively this yarn clamp 13 may be adjusted as follows: First the adjustment screw 49 is rotated to adjust the clamping force exerted by the clamp element 24 through its clamping segment 25 on the clamping surface 21 of the clamping segment 20 of the other clamp element; then the angular position between the clamping surface 21 of the clamping segment 20 and the clamping segment 25 is set at a desired angle by the adjustment screw 39. These steps may be carried out before the main body 54 is secured to the gripper housing 19, or, alternatively, afterwards. If it is discovered during weaving that the yarn clamp 13 does not optimally clamp the filling, the yarn clamp 13 can be readjusted using the adjustment devices 30 and/or 31 without having to disassemble the yarn clamp 13 from the gripper housing 19.

The clamping segment 20 is fitted with a retention device 36 in the embodiment shown in FIGS. 6 and 7, where said retention device is firmly secured by one or more screws 53 to the main body 54 of the clamp element 20. The bendable connection 37 and the adjustment device 30 are located in this embodiment between the retention device 36 and the clamping segment 20.

Obviously as well, more than the two adjustment devices 30, 31 with elastically bendable connections 37, 47 may be used, in which case they would be located at different locations between the fixed main body 54 and the extension 46 or the retention device 36.

Other drive means acting as the adjustment device may be used to move the displaceable clamp element 24 in order to open the yarn clamp 13.

Figure 8:
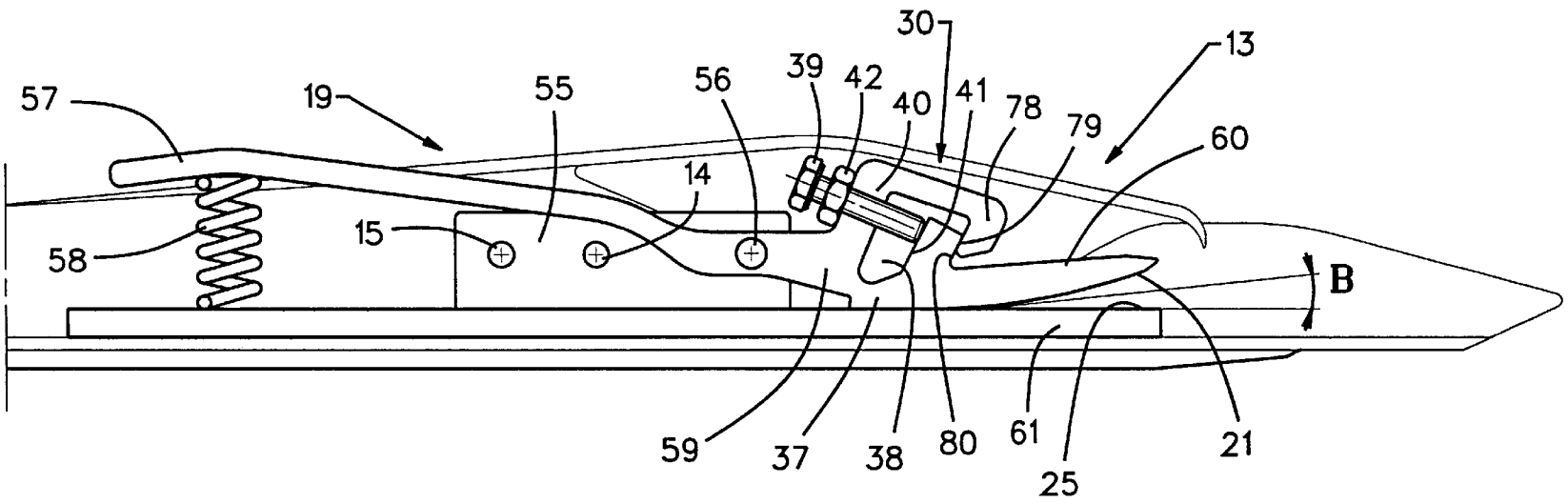
FIG. 8 shows a section view of a further embodiment that is similar to FIG. 3.

FIG. 8 shows another embodiment comprising a fixed clamp element 61 fitted with a clamping segment 25. The clamp element 61 is integral with a retention device 55 which is secured in fixed manner by fasteners 14, 15 to the gripper housing 19. The clamping segment 25 of the fixed clamp element 61 cooperates with a movable clamping segment 60 fitted with a clamping surface 21. The clamping segment 60 is integral with a two-arm lever 57 which pivots about a shaft 56 mounted on the retention device 55. A compressions spring 58 is mounted between the lever 57 and the rearward-extended portion of fixed clamp element 60 and presses the clamping segment against clamping segment 60, 61. The lever arm 59 comprising the movable clamping segment 60 is fitted with an adjustment device 30 corresponding to the embodiment of FIGS. 1 through 5 to allow adjusting the angle B. In order to open the yarn clamp, the lever 57 is pivoted anti-clockwise about the shaft 56 by means of a stop (not shown) against the force of the compression spring 58.

In the embodiment of FIG. 8, the protrusion 40 is fitted with a hook-shaped stop 78 constituting a stop surface 79 which cooperates with a stop surface 80 of the clamping segment 60. In this embodiment as well the excursion of adjustment is limited by said hook-shaped stop 78.

The invention is not restricted to the particular embodiments shown above. In particular these embodiments maybe combined. For instance real articulation may be used instead of the elastically bendable joints 37 or 47 to attain the same functions. The elastic joints 37, 47 however do offer the advantage of being free of wear and play. Other steps furthermore may be used to limit the excursion of the adjustment devices 30, 31 instead of the hook-shaped stops 70, 75, 78. For instance the same function also may be attained by selecting the length of the adjustment screws 39, 49 in such manner that plastic deformation shall be reliably precluded. Obviously as well, other adjustment means may be used in the zone of the elastic connections 37, 47 that will also offer a given elastic deformation at such junction sites, for instance by expansion elements inserted into the clearances 38, 48.

In the illustrative embodiments above, the yarn clamp was disclosed as being part of a drawing gripper. Clearly, a correspondingly designed yarn clamp also may be used with a receiving gripper.

What is claimed is:

1. A yarn clamp for a gripper weaving machine comprising:

a housing;

a pair of clamp elements mounted to the housing, each clamp element having a clamping segment, wherein the clamping segments are disposed in opposed clamping relationship and are arranged to clamp a filling yarn between the clamping segments;

one of the clamp elements comprising a main body including a respective main body clamping segment, said main body and its respective main body clamping segment formed in one integral piece;

a position adjuster configured to adjust the position of the respective main body clamping segment relative to the position of the main body and relative to the opposing clamping segment of the other clamp element.

2. A yarn clamp for a gripper weaving machine comprising:

a housing;

a pair of clamp elements mounted to the housing, each clamp element having a clamping segment, wherein the clamping segments are disposed in opposed clamping relationship and are arranged to clamp a filling yarn between the clamping segments;

one of the clamp elements comprising a main body including a respective clamping segment, said main body and its respective clamping segment formed in one integral piece;

a position adjuster configured to adjust the position of at least one of the clamping segments relative to the position of the main body, and relative to the opposing clamping segment of the other clamp element;

said main body being bendable and said position adjuster arranged to bend a portion of the main body to effect adjustment of the at least one clamping segment relative to the position of a non-bent portion of the main body.

3. The yarn clamp as claimed in claim 1 or 2, wherein said main body includes a joint which is elastically bendable by means of said position adjuster.

4. The yarn clamp as claimed in claim 2, wherein the respective main body clamping segment is mounted by means of a retention device on the main body and wherein a bendable joint is provided between the respective main body clamping segment and the retention device.

5. The yarn clamp as claimed in claim 3, wherein the adjustment device includes an adjustment screw mounted in the area of the joint.

6. The yarn clamp as claimed in claim 1 or 2, wherein the main body is mounted to the housing in a fixed manner and the opposing clamp element is affixed to the main body.

7. The yarn clamp as claimed in claim 1 or 2, wherein the main body is relatively fixed and the opposing clamping segment comprises a portion of a leaf spring that is moveable relative to said main body portion, said leaf spring including an end portion located away from said opposing clamping segment, said end portion attached to said main body at a location that is remote from said main body clamping segment.

8. The yarn clamp as claimed in claim 7, wherein said main body includes an extension portion and wherein the position of the extension portion is adjustable relative to said main body, and wherein said leaf spring end portion is secured to said main body at said extension portion.

9. The yarn clamp as claimed in claim 1 or 2, including a pivoted lever arrangement defining moveable lever arms, said respective main body clamping segment and bendable main body comprising one of said lever arms.

10. The yarn clamp as claimed in claim 1, including an excursion limit device associated with said position adjuster, said excursion limit device arranged to limit the degree of excursion of the position of the respective main body segment relative to the position of the main body.

11. The yarn clamp as claimed in claim 1 or 2, including an excursion limit device associated with said position adjuster, said excursion limit device arranged to limit the degree of excursion of the position of the at least one clamping segment relative to the position of the main body.

12. The yarn clamp as claimed in claim 1 or 2, wherein one of the clamping segments includes a rib and the opposing clamping segment includes a groove, said rib and groove cooperating with each other for clamping a filling yarn.

13. A yarn clamp (13) for a gripper (1) of a rapier weaving machine having two clamp elements for clamping a filling yarn, each clamp element comprising a clamping segment (20, 25) whereby the clamping segments are disposed opposite each other, characterized in that the clamping segment (20, 25) of at least one of the clamp elements is adjustable relative to the clamping segment (25, 20) of the other clamp element and relative to its main body (18, 54, 59); and further characterized in that a joint (37, 47) which is elastically bendable by means of an adjustment device (30, 31) is provided between the main body (18, 54, 59) of the clamp element and the adjustable clamping segment (20,25).

14. The yarn clamp as claimed in claim 13, characterized in that the clamping segment (20) is mounted using a retention device (36) on the main body (54) and in that the bendable joint (37) is provided between the clamping segment(20) and the retention device (36).

15. The yarn clamp as claimed in claim 13, characterized in that the adjustment device (30, 31) includes an adjusting screw (39, 49) mounted in the area of the joint (37, 47).

16. The yarn clamp as claimed in claim 13, characterized in that one clamp element is mounted in a fixed manner and the other clamp element (24) is mounted so as to be relatively moveable with respect to the one clamp element, and in that the fixed clamp element is fitted with the adjustable clamping segment (20); and further characterized in that the yarn clamp comprises one fixed clamp element and one clamp element that is moveable relative to said fixed clamp element, and wherein the moveable clamp element (24) is a leaf spring constituting a clamping segment (25), the end (26) of said leaf spring located away from the clamping segment (25) being secured to an extension (27, 46) of the main body (18, 54) of the other clamp element.

17. The yarn clamp as claimed in claim 16, wherein the position of the extension (46) of the main body (54) relative to the main body (54) is adjustable.

18. The yarn clamp as claimed in claim 13, characterized in that at least one adjustment device (30, 31) is fitted with means (70, 75, 78) to limit the adjustment excursion.

19. Yarn clamp as claimed in claim 13, characterized in that one of the clamping segments (20) is fitted with a rib running along its longitudinal direction and which cooperates with a longitudinal groove (29) in the opposed clamping segment (25).

20. A yam clamp (13) for a gripper (1) of a rapier weaving machine having two clamp elements for clamping a filling yarn, each clamp element comprising a clamping segment (20, 25) whereby the clamping segments are disposed opposite each other, characterized in that the clamping segment (20, 25) of at least one of the clamp elements is adjustable relative to the clamping segment (25, 20) of the other clamp element and relative to its main body (18, 54, 59); and further characterized in that the clamping segment (20) is mounted using a retention device (36) on the main body (54) and in that a bendable joint (37) is provided between the clamping segment (20) and the retention device (36).

21. A yam clamp (13) for a gripper (1) of a rapier weaving machine having two clamp elements for clamping a filling yarn, each clamp element comprising a clamping segment (20, 25) whereby the clamping segments are disposed opposite each other, characterized in that the clamping segment (20, 25) of at least one of the clamp elements is adjustable relative to the clamping segment (25, 20) of the other clamp element and relative to its main body (18, 54, 59); and further characterized in that one of the clamping segment (20) is fitted with a rib running along its longitudinal direction and which cooperates with a longitudinal groove (29) in the opposed segment (25).

* * * * *